United States Patent [19]

Hermes et al.

[11] 3,992,915

[45] Nov. 23, 1976

[54] ROLLING MILL

[75] Inventors: Robert J. Hermes, Wyomissing; John F. Turner, West Lawn, both of Pa.

[73] Assignee: Birdsboro Corporation, Birdsboro, Pa.

[22] Filed: Apr. 21, 1975

[21] Appl. No.: 569,767

[52] U.S. Cl. ..... 72/234; 72/249

[51] Int. Cl.[2] ..... B21B 35/02

[58] Field of Search ..... 72/249, 234, 235

[56] References Cited

UNITED STATES PATENTS

| | | | |
|---|---|---|---|
| 2,583,935 | 1/1952 | Falk | 72/249 X |
| 3,016,772 | 1/1962 | Hornbostel | 72/249 |
| 3,320,827 | 5/1967 | Rumrich | 72/249 X |
| 3,383,896 | 5/1968 | Blinn | 72/226 |
| 3,587,277 | 6/1971 | Pigni | 72/234 |

*Primary Examiner*—Milton S. Mehr

*Attorney, Agent, or Firm*—Fred Wiviott

[57] ABSTRACT

A rolling mill having a plurality of serially connected roll stands and a finishing stand. A differential drive is provided between the first two stands of the finishing rolls so that different area reduction may be achieved in the finishing stands from a common preceeding stand.

13 Claims, 4 Drawing Figures

ROLLING MILL

BACKGROUND OF THE INVENTION

In a conventional rolling mill for forming metal products, such as a rod mill, when a different finished product size is required, it is often necessary to adjust the process sections of a roughing or intermediate mill at a number of roll stands. This adjustment is accomplished by moving the head screws changing the parting of the mill rolls, or changing the rolls. Readjustment of the entry guides and delivery guides in the stands to permit different size process sections to be properly held in the bite of the mill rolls is also required. In addition, the stand speed in rpm of the various rolls must also be corrected to allow for the different volume of material being delivered from each of the stands in question. Similar adjustments may also have to be made to allow for variations of spread of the material being rolled due to various grades or analyses.

SUMMARY OF THE INVENTION

It is an object of the invention to provide an improved rolling mill in which a common section from a roughing or intermediate mill may be utilized in a finishing mill for obtaining a wide range of finished product sizes.

Another object of the invention is to provide a rolling mill in which a wide range of finished product sizes may be obtained from a common intermediate section wherein substantial adjustments to the intermediate section is not required.

These and other objects and advantages of the invention will become more apparent from a detailed description of a preferred embodiment which follows.

The invention generally comprises a rolling mill having roughing and/or intermediate roll stands and finishing roll stands wherein a differential drive joins the first and second finishing stands. The differential drive varies the relative roll speed of the two stands to accommodate a common section of the preceding intermediate stands whereby a variety of finished sizes may be obtained with minimal adjustment and whereby differences in spread characteristics of the product being rolled are automatically accommodated.

DESCRIPTION OF A PREFERRED EMBODIMENT

Figure 1:
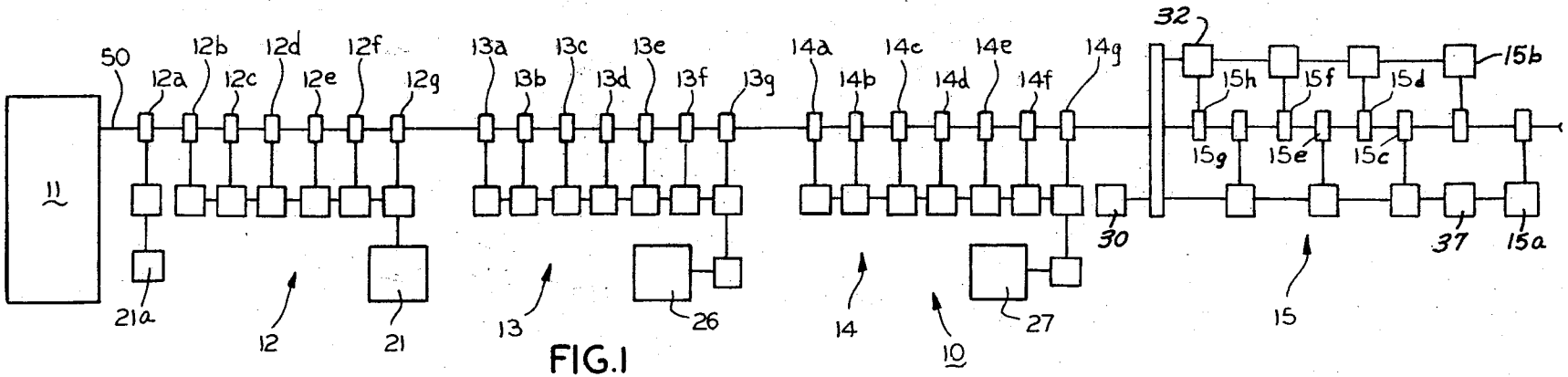
FIG. 1 schematically illustrates a rolling mill constructed and arranged according to the present invention.

The drawing illustrates a rolling mill 10 for producing continuously formed steel products, or other metal products, and including a billet heating furnace 11, a roughing block of roll stands 12, first and second intermediate blocks of roll stands 13 and 14 and a finishing block of roll stands 15. The roughing block 12 may include a plurality of aligned roll stands 12*a*–12*g* which may comprise horizontal and/or vertical rolls. Those skilled in the art will appreciate that the roughing roll stands 12*a*–12*g* may be driven by a common drive or each may be driven by an individual drive unit. In the illustrated embodiment, stand 12*a* is provided with an individual drive 21*a* and roll stands 12*b*–12*g* driven by a common drive 21. The roll stands and drives are well known in the art and accordingly will not be described in detail.

The intermediate blocks 13 and 14 may each similarly include a plurality of aligned roll stands 13*a*–13*g* and 14*a*–14*g* respectively, each of which may respectively have a common drive means 26 and 27, associated therewith. The roll stands 13*a*–13*g* and 14*a*–14*g* and the drives 26 and 27 may be of any conventional design well know to those skilled in the art.

Figure 2:
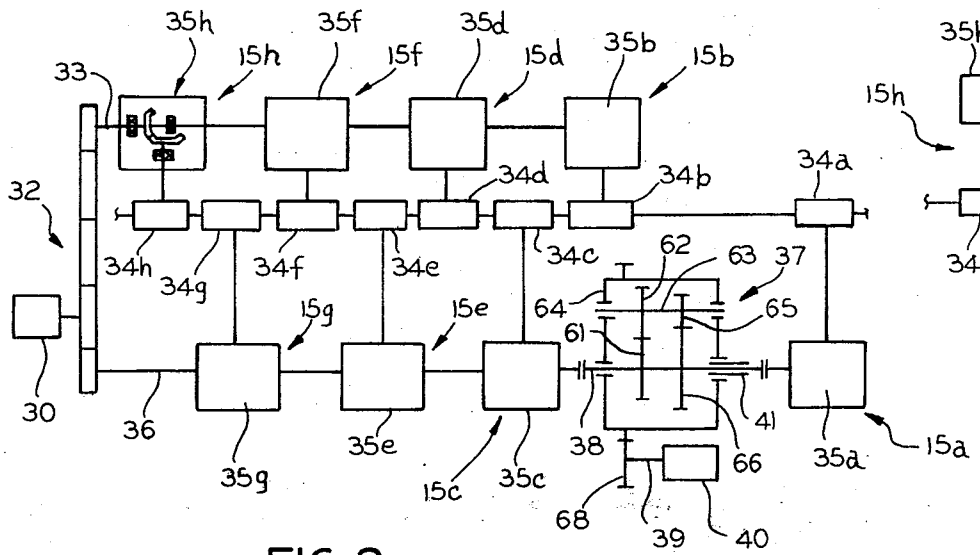
FIG. 2 illustrates a portion of the rolling mill of FIG. 1 in greater detail.

As seen more particularly in FIG. 2, the finishing block 15 may also include a plurality of roll stands 15*a*–15*g* which are driven by a common prime mover 30. Those skilled in the art will appreciate that the roll stands 15*a*–15*g* may be connected to the prime mover 30 by any suitable coupling mechanism. For purposes of illustration, the coupling mechanism is schematically illustrated in FIG. 2 to include a suitable reduction gear mechanism 32. A first output shaft 33 extends from gear reduction mechanism 32 and is suitably coupled to the rolls 34*b*, 34*d*, 34*f* and 34*h* of roll stands 15*b*, 15*d*, 15*f* and 15*h* by suitable drive gears such as that schematically illustrated at 35*b*, 35*d*, 35*f* and 35*h*. The rolls 35*c*, 35*e* and 35*g* are similarly coupled to gear reduction mechanism 32 by a shaft 36.

The drive gears 35*a* of the roll stand 15*a* are coupled to the shaft 36 through a mechanism 37 which includes an input shaft 38 coupled shaft 36, a control shaft 39 coupled to a variable speed motor 40 and an output shaft 41 coupled to drive gears 35*a*. The differential 37 may be of any conventional type such that the speed of the output shaft 41 is a function of the relative speeds of the input and control shafts 38 and 39 and the gear ratios between the various shafts. By controlling the speed of the control motor 40 the speed relationship of roll stand 15*a* relative to the stands 15*b*–15*a*, can be controlled.

In operation of rolling mill 10, a metal billet 50 from furnace 11 are passed sequentially through the roughing block 12, the intermediate blocks 13 and 14 for a progressive reduction in its cross section in a manner well known in the art. As is also known, the relationship of each roll stand to the other in blocks 12-14 with regard to speed is such that the volume of material delivered from one stand must be substantially equal to that being accepted and delivered by the next roll stand. The rate of volume passing through each roll stand may be expressed by the expression: $C = A \times WD \times \text{rpm}$ where $C$ = a Constant or a Factor representing volume of material $A$ = Area of the section in square inches $WD$ = the Work Diameter or Effective Diameter of the particular mill roll $rpm$ = Revolutions per Minute of the mill rolls Obiously, as the cross sectional area of the strand 50 is reduced progressively by the roll stands, the RPM and/or the WD of the adjacent rolls must be adjusted to maintain a constant rate of volume flow of material. Based upon the particular work diameter of the mill rolls in roll stands 12*a*–12*g*, 13*a*–13*f* and 14*a*–14*f* the speeds of the drives 21, 21*a*, 26 and 27 must be adjusted accordingly. In conventional mills, the finishing block 15 is constructed in a manner similar to the roughing and intermediate mills 12, 13, and 14. When it was desired to change the finished strand sizes in prior art mills, a number of the roll stands in the intermediate section had to be adjusted. This required moving the headscrews and changing the parting of the mill rolls. In addition, it was necessary to readjust the entry and delivery guides to permit the different size of process sections to be properly held in the bite of the mill rolls and to be delivered correctly. Also required was a correction to the stand speeds in RPM, to allow for the different volume of metal being delivered from each of the adjusted stands. In some instances, the rolls themselves had to be changed.

In the present invention, the differential 37 and the control motor 35 eliminates the necessity of many of the aforementioned adjustments. The differential 37 makes it possible to vary the draft or area reduction of the strand 50 as it passes through roll stands 15*a* and 15*b* to permit a common strand section size from intermediate block 14 to be utilized for a variety of final finish sizes. This is accomplished by adjusting the first two finishing strands 15*a* and 15*b* and changing the speed of the control motor 40 whereby the differential 37 adjusts the speed of the roll stand 15*a* relative to that of roll strand 15*b* so that they correspond to the area reduction of the strand. Assume, for example, that during one period of operation, a 7/32 inch diameter product is desired and during a second, a ¼ inch diameter is desired and that the diameter of the strand exiting roll stand 14*f* is 0.48 inches. It will be apparent that in the case of the 7/32 inch output, a greater reduction in the finishing stands is required than with respect to the ¼ inch bar. For this reason, the relative speed of rolls 15*a* and 15*b* will be different for each size product. In addition, the speed of rolls 15*a* must relate to the substantially unaltered speed of stand 14*f* while the speed of stand 15*b* must also relate to the speed of stand 15*c*.

Those skilled in the art will appreciate that the differential 37 may be of any conventional type, such as, for example, the planetary gear system schematically in FIG. 2. Here a first gear 61 is mounted on an input shaft 38 and meshes with a first planetary gear 62 mounted on shaft 63 which is journaled in carrier 64. A second gear 65 is also mounted on shaft 63 and meshes with gear 66 mounted on output shaft 41. The carrier 64 is coupled for rotation by a gear 68 to input shaft 39. It can be seen that the speed of the output shaft 41 will be functionally related to the relative speeds of the input shaft 38 and the control shaft 39. One type of differential which may be employed for this purpose is the Ratomission manufactured by Plessy Airborne Corporation.

The speed adjustment between rolls 15*a* and 15*b* also adjusts for different spread characteristics for different alloys. Thus if the reduction of strand 50 differs from the nominal value, the speed of control motor 40 is adjusted to readjust the relative speeds of rolls 34*a* and 34*b* to accommodate such variations.

Figure 3:
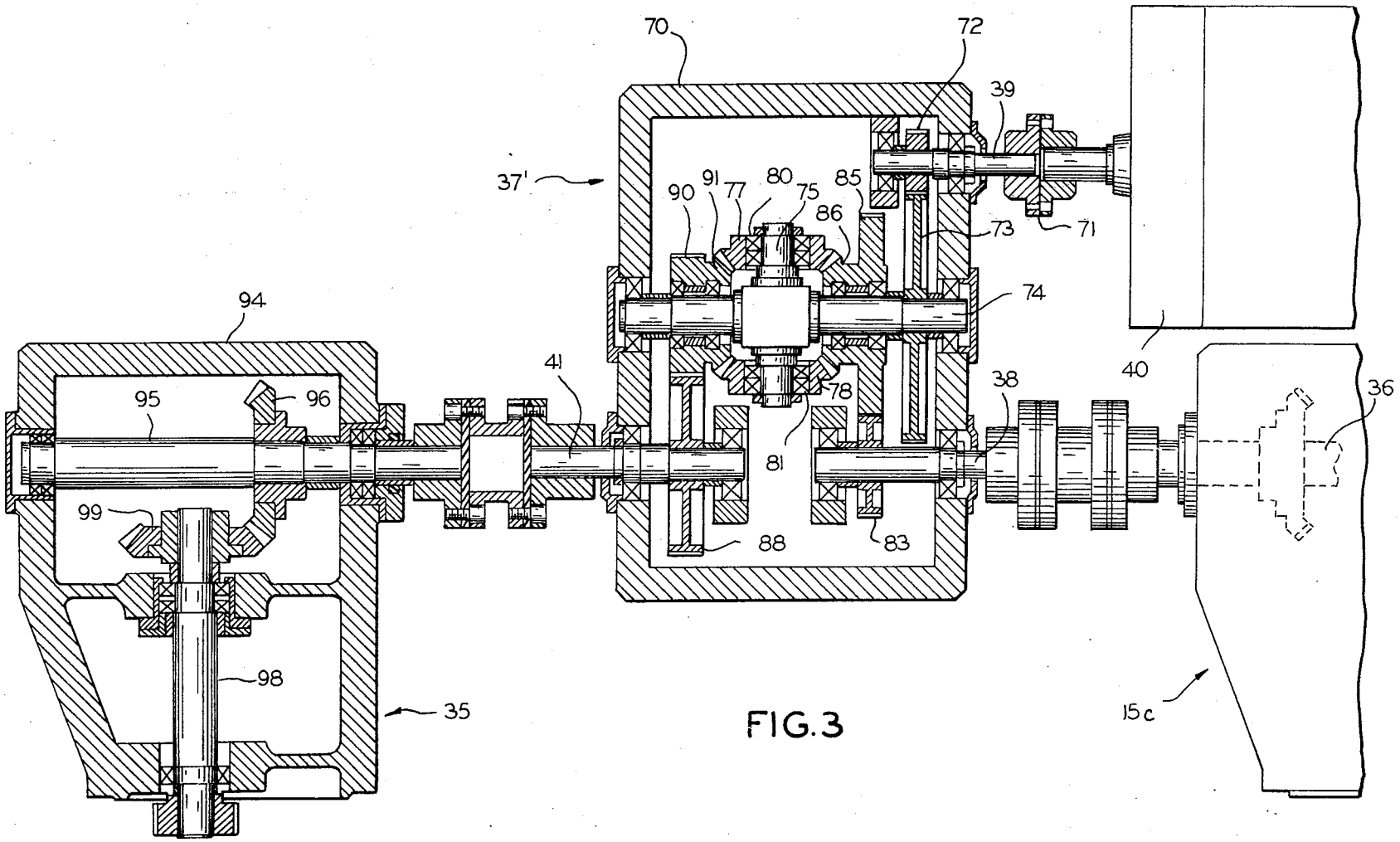
FIG. 3 illustrates in greater detail a differential usable in the embodiment of FIG. 2.

FIG. 3 shows another type of differential assembly 37′ which may be employed in the present invention. Differential 37′ includes a housing 70 in which the differential shafts 38, 39 and 41 are journaled for rotation. A first pinion gear 72 is mounted on control shaft 39 and meshes with a spur gear 73 to a shaft 74 which is also journaled for rotation in housing 70 and in general parallelism with he shafts 38, 39 and 41. Mounted intermediate the ends of the shaft 74 and extending generally normally thereto is a spindle 75. A pair of bevel gears 77 and 78 are rotatably mounted on the opposite ends of spindle 75 by means of bearings 80 and 81 respectively. A second pinion gear 83 is mounted on the input shaft 38 and meshes with a spur gear 85 which is rotatably mounted on shaft 74. A bevel gear 86 is intergally formed on one face of gear 85 and meshes with each of the bevel gears 77 and 78. A third pinion gear 88 is affixed to the output shaft 41 and meshes with a second gear 90 rotatably mounted on shaft 74 and having an intergal bevel gear 91 formed on one face and which also meshes with the bevel gears 77 and 78.

Those skilled in the art will appreciate that the input shaft 38 will rotate at the speed of line shaft 36 and will rotate the output shaft 41 through the agency of the gears 83, 85, 86, 77, 78, 90 and 88. Assuming that control motor 40 is at rest, the speed ratio of shafts 38 and 41 will be determined by the relative number of teeth in the gears 83, 85, 86, 77, 78, 90 and 88. However, when the variable speed, reversable control motor 40 is actuated, the gears 72 and 73 will be rotated to rotate the spindle 75 in a direction governed by the direction of rotation of motor 40. The rotation of spindle 45 will cause bevel gears 77 and 78 to rotate in either an additive or subtractive sense relative to the direction of shaft 38, depending upon its direction of rotation. As a result, the speed of shaft 41 relative to the speed of shaft 38 may be modified in accordance with the speed and direction of rotation of the spindle 75. In this manner, the speed of the roll 34*a* relative to line shafts speed may be closely controlled.

FIG. 3 also shows the gear coupling mechanism 35*a* to include a housing 94 in which a shaft 95 is journaled for rotation. Shaft 95 is coupled to the output shaft 41 of differential 37′ and carries a first bevel gear 96. A second shaft 98 is journaled in housing 94 for rotation about an axis generally normal to the axis 95 and carries a second bevel gear 99 which meshes with the gear 96. The shaft 98 is in turn coupled to the roll 34*a*. The drive assembly 35*a* is typical and hence the remaining drive assemblies 34*b*–34*a* may be similar.

Figure 4:
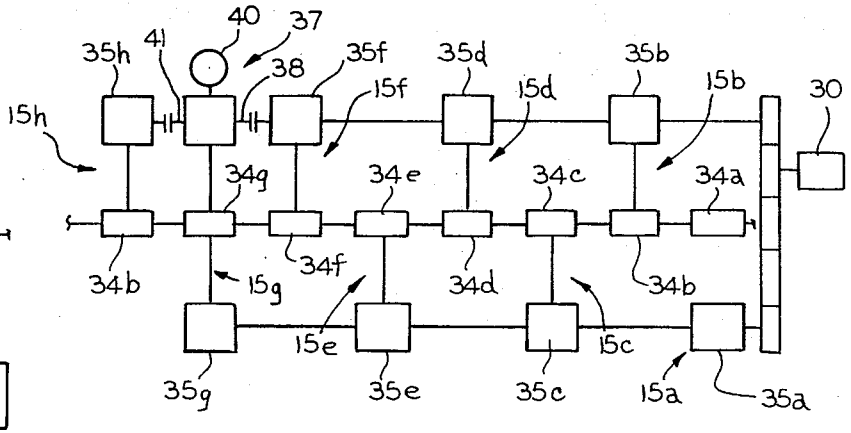
FIG. 4 illustrates an alternate embodiment of the invention.

FIG. 4 shows an alternate embodiment of the invention wherein the differential 37 is coupled between roll stands 15*g* and 15*h*. This permits the adjustment of the relative speeds between the last two strands 15*g* and 15*h* to compensate for an increase or decrease in the tension between the stands resulting from different spread characteristics of various stands which, in turn, will affect the final shape of the finished strand. In addition, this arrangement can be employed for adjusting the tension in the strand 50 between strands 15*g* and 15*h*.

While only a few embodiments of the invention have thus been described, the invention is not intended to be limited thereby, but only by the scope of the appended claims.

We claim as our invention:

1. A rolling mill having a plurality of groups of serially arranged roll stands, each roll stand havin rolls through which a metal strand passes for cross-sectional reduction and elongation, passage of said strand through successive roll stands successively elongating and reducing said strand, drive means for rotating said rolls, a terminal group of said roll stands comprise a finishing group, said drive means including a common drive assembly for at least the first and second roll stands of said terminal group, one of said first and second roll stands being coupling to said common drive assembly, and differential means coupling the other of said first and second roll stands to said drive assembly, said differential means being operative for rotating the rolls of one of said first and second roll stands at a predetermined speed relative to the speed at which the rolls of the other of said first and second roll stands is rotated by said common drive assembly so that said finishing group may produce a final product having a first predetermined cross-sectional area upon receipt of a strand having a second predetermined cross-sectional area from the preceeding group of roll stands in said serial arrangement.

said differential means including adjustment means for adjusting the speed relation of the rolls of said first and second roll stands so that said finishing group may produce a final product having a third predetermined cross-sectional area upon receipt of a strand from said preceding group having said second predetermined cross-sectional area whereby the cross-sectional area of said finished product may be varied without adjusting the roll stands of said preceding group.

2. The rolling mill set forth in claim 1 wherein said rolling mill includes a roughing group of roll stands, at least one intermediate group of roll stands, said strand passing serially through the roll stands of said roughing, intermediate and finishing stands, said differential means being located between the first and second roll stands of said finishing group whereby the speed of the first roll stand in said finishing group can be adjusted in relation to the remaining roll stands of said finishing group.

3. The rolling mill set forth in claim 2 wherein said drive means includes prime mover means coupled directly to one of said first and second roll stands, said differential means having an input coupled to said prime mover means and an output connected to the other one of said first and second roll stands.

4. The rolling mill set forth in claim 3 wherein said differential means comprises a differential gear assembly, said differential gear assembly having a control input and being constructed and arranged to control the speed of said output as a function of the relative speeds of said input.

5. The rolling mill set forth in clam 4 wherein said input, said output and said control input each include a shaft coupled to said differential gear assembly and a variable speed control motor means coupled to said control input shaft.

6. The rolling mill set forth in claim 1 wherein each of the roll stands of said finishing group includes drive gear means, a single drive assembly connected to each of the drive gear means except the drive gear means of the first one of said roll stands, said differential means coupling the drive gear means of the first one of the roll stands in said finishing block to said drive assembly, the drive gear means of each of the remaining stands of said finishing group being connected to said drive assembly through reduction gear means.

7. The rolling mill set forth in claim 1 wherein said rolling mill includes a roughing group of roll stands, at least one intermediate group of roll stands and a final group of finishing roll stands, said drive means including a common drive assembly for each of the rolls of said finishing group, said strand passing serially through the roll strands of said roughing, intermediate and finishing stands, said differential means comprising gear means coupled to said first roll stand of said finishing group and to said drive mens for adjusting the the speed of said first roll stand relative to the remaining stands of said group, said adjustment means being operative for controlling the speed adjustment between said first roll stand relative to the remaining stands of said finishing group.

8. A rolling mill having a plurality of roll stands which include a roughing group of roll stands, at least one intermediate group of roll stands and a group of finishing roll stands, each roll stand having roll means through which a metal strand passes for successive cross-sectional reduction and elongation of said strand as it traverses successively throgh said roughing, intermediate and finishing roll stands, drive means for rotating successive roll means at a greater speed than preceding roll means to permit said roll means to compressively engage said strand as it becomes smaller in cross-sectional area and elongated, said drive means including a drive assembly for the roll stands of said group of finishing roll stands, all of the roll stands of said finishing group except an end stand being coupled to said drive assembly for rotation of their respective roll means at predetermined speeds, differential means coupling said end roll stand to said drive assembly for driving the roll means of said end roll stand at a speed which is functionally related to the speed of the other roll stands of said finishing group, control means coupled to said differential means for adjusting the relative speed of said end roll stand relative to the remaining roll stands of said finishing group whereby said finishing stands may be adjusted to provide finished products of different sizes without adjusting the roll stands of the intermediate group.

9. The rolling mill set forth in claim 8 wherein the end roll stand comprises the first roll stand in said finishing group and which is positioned to receive a strand from said intermediate group.

10. The apparatus set forth in claim 9 wherein said differential means includes first gear means coupling said drive assembly to the roll means of said first roll stand for driving the same at a speed having a predetermined relation to the speed of said drive assembly, and second gear means coupled to said first gear means and adopted for modifying the speed relation between said control means and the roll means of said first roll stand, said control means being coupling to said second gear means.

11. The invention set forth in claim 10 wherein each of the roll stands of said finishing group except the first are coupled to a common drive, whereby the speed of the first roll stand may be adjusted by said differential means relative to each of the other roll stands of said group.

12. The invention set forth in claim 11 wherein said control means comprises a variable speed motor.

13. A method of adjusting the final cross-sectional area of a strand passing serially through a group of roughing roll stands, an intermediate group of roll stands and a finishing group of roll stands, each of said groups including a plurality of roll stands, said roll stands successively reducing the cross-sectional area and elongating said strand, comprising the steps of:

delivering said strand from said intermediate group of stands to said finishing group at a first predetermined cross-sectional area, operating the first roll stand of said finishing group at a predetermined speed relative to the remaining roll stands of said group to provide a final product having a second predetermined cross-sectional area, adjusting at least some of the rolls of said finishing group to provide a different reduction in cross-sectional area and elongation of said strand, adjusting the relative speed of said first roll stand of said finishing group to provide a different speed relation between said first roll stand and the remaining roll stands thereof, and effecting a final product having a third predetermined cross-sectional area by continuing to deliver a strand having said first predetermined cross-sectional area from said intermediate group to said finishing group.

* * * * *

UNITED STATES PATENT OFFICE

CERTIFICATE OF CORRECTION

Patent No. 3,992,915 Dated November 23, 1976

Inventor(s) Robert J. Hermes & John F. Turner

It is certified that error appears in the above-identified patent and that said Letters Patent are hereby corrected as shown below:

Claim 1, column 4, line 59, change "havin" to --having--.

Claim 1, column 5, line 1, change "coupling" to --coupled--.

Claim 5, column 5, line 47, change "clam" to --claim--.

Claim 7, column 5, line 68, change "strands" to --stands--.

Claim 7, column 6, line 3, change "mens" to --means--; same line, before "speed" delete "the".

Claim 8, column 6, line 15, change "throgh" to --through--.

Signed and Sealed this

Twenty-second Day of March 1977

[SEAL]

*Attest:*

RUTH C. MASON
*Attesting Officer*

C. MARSHALL DANN
*Commissioner of Patents and Trademarks*